US008594535B2

(12) United States Patent
Garcia

(10) Patent No.: US 8,594,535 B2
(45) Date of Patent: Nov. 26, 2013

(54) ROLLER EXTERIOR LAYER COMPRISING POLYMER, CARBON BLACK AND SOLUBLE IONIC SALT

(75) Inventor: Benjamin W. C. Garcia, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 272 days.

(21) Appl. No.: 13/119,959

(22) PCT Filed: Oct. 1, 2008

(86) PCT No.: PCT/US2008/078512

§ 371 (c)(1), (2), (4) Date: Mar. 19, 2011

(87) PCT Pub. No.: WO2010/039134

PCT Pub. Date: Apr. 8, 2010

(65) Prior Publication Data

US 2011/0170909 A1 Jul. 14, 2011

(51) Int. Cl.
*G03G 15/10* (2006.01)

(52) U.S. Cl.
USPC ..... 399/239

(58) Field of Classification Search
USPC ..... 399/176, 239, 240, 265, 279, 286
See application file for complete search history.

(56) References Cited

U.S. PATENT DOCUMENTS

| | | | | |
|---|---|---|---|---|
| 5,481,341 | A * | 1/1996 | Sypula et al. | 399/239 |
| 6,067,434 | A | 5/2000 | Takagi et al. | |
| 6,117,557 | A | 9/2000 | Massie, II et al. | |
| 6,122,473 | A | 9/2000 | Goseki et al. | |
| 6,397,032 | B1 | 5/2002 | Sakaizawa et al. | |
| 6,876,371 | B2 | 4/2005 | Suzuki et al. | |
| 7,406,277 | B2 * | 7/2008 | Mizumoto | 399/176 |
| 7,450,892 | B2 | 11/2008 | Tsubota et al. | |
| 2002/0122997 | A1 | 9/2002 | Lee et al. | |
| 2005/0214033 | A1 | 9/2005 | MacMillan et al. | |
| 2006/0020100 | A1 | 1/2006 | Lee et al. | |
| 2007/0066468 | A1 | 3/2007 | Kim | |
| 2008/0070147 | A1 | 3/2008 | Uchino et al. | |

* cited by examiner

*Primary Examiner* — Hoang Ngo

(57) ABSTRACT

A roller comprises an exterior layer including one or more polymers, carbon black and an ionic salt soluble in a low molecular weight hydrocarbon oil.

15 Claims, 2 Drawing Sheets

ROLLER EXTERIOR LAYER COMPRISING POLYMER, CARBON BLACK AND SOLUBLE IONIC SALT

BACKGROUND

Printing systems sometimes employ rollers to transfer electrostatically charged imaging material to an imaging surface such as a photoconductor drum. Existing rollers may not provide a desired level at resistance or may harm the imaging surface or its performance over time.

DETAILED DESCRIPTION OF THE EXAMPLE EMBODIMENTS

Figure 1:
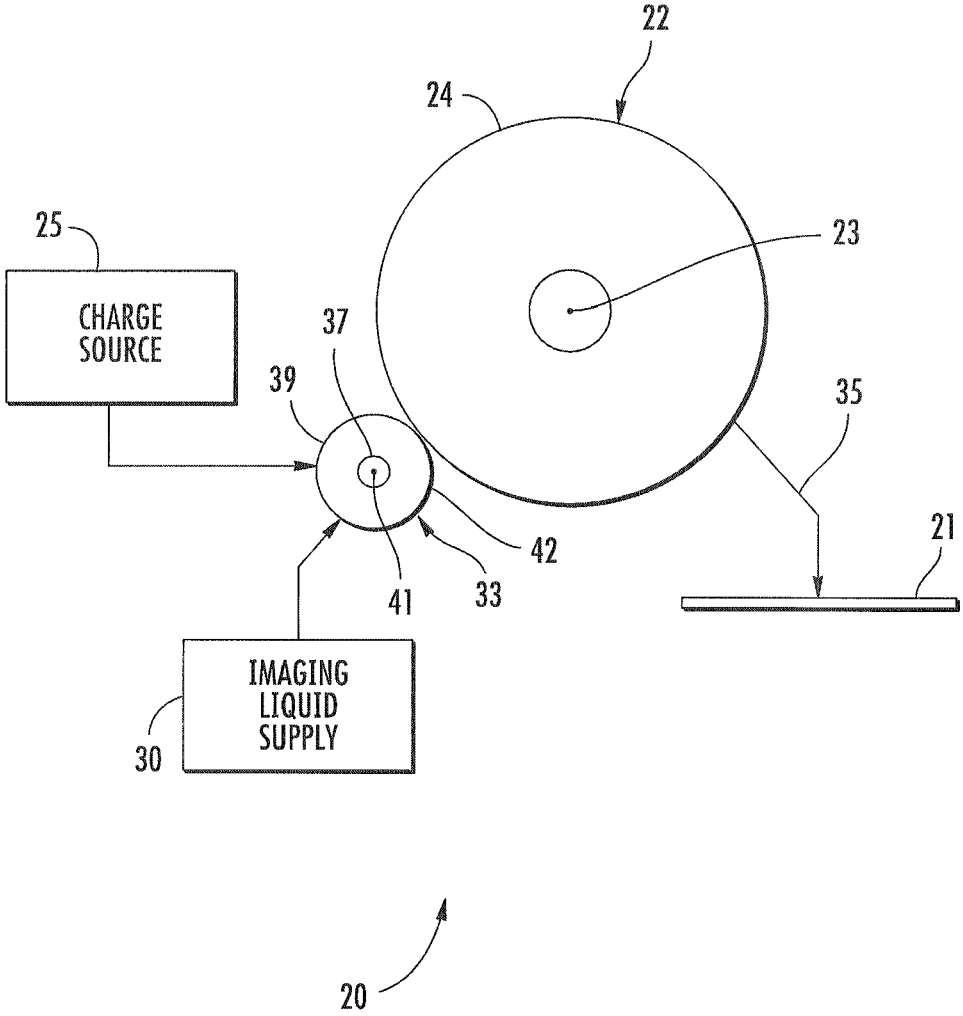
FIG. 1 is a schematic illustration of a printer including a developer roller according to an example embodiment.

FIG. 1 schematically illustrates imaging system or printer 20 according to an example embodiment. Printer 20 forms images upon a print medium 21 using an electrostatically charged imaging material, such as an imaging liquid or ink. As will be described hereafter, printer 20 includes a developer roller 33 that transfers the electrostatically charged imaging liquid to an electrostatically charged imaging surface 24. The developer roller 33 has an outer layer having a composition that provides a desired level of electrical conductivity and reduces long-term damage to the imaging surface 24 or its performance over time.

Printer 20 includes imaging member 22 having imaging surface 24, charge source 25, imaging liquid supply 30 and developer roller 33. Imaging member 24 comprises a member supporting imaging surface 24. Imaging surface 24 (sometimes referred to as an imaging plate) comprises a surface configured to have one or more electrostatic patterns or images formed thereon and to have electrostatically charged imaging material, such as imaging liquid, applied thereto. The imaging material adheres to selective portions of imaging surface 24 based upon the electrostatic images on surface 24 to form imaging material images on surface 24. The imaging material images are then subsequently transferred to a print medium 21 as indicated by arrow 35. Such transfer may be achieved using one of more belts, drums and the like.

In the example illustrated, imaging member 22 comprises a drum configured be rotated about axis 23. In other embodiments, imaging member 22 may comprise a belt or other supporting structures. In the example illustrated, surface 24 comprises a photoconductor or photoreceptor configured to be charged and have portions selectively discharged in response to optical radiation such that the charged and discharged areas form the electrostatic images. In other embodiments, surface 24 may be either selectively charged or selectively discharged in other manners. For example, ionic beams or activation of individual pixels along surface 24 using transistors may be used to form electrostatic images on surface 24.

In the embodiment illustrated, imaging surface 24 comprises a photoconductive polymer. In one embodiment, imaging surface 24 has an outermost layer with a composition of a polymer matrix including charge transfer molecules (also known as a photoacid). In on embodiment, the matrix may comprise a polycarbonate matrix including a charge transfer molecule that in response to impingement by light, generates an electrostatic charge that is transferred to the surface. In other embodiments, imaging surface 24 may comprise other photoconductive polymer compositions.

Charge source 25 comprises a device configured to electrostatically charge developer roller 33 so as to electrostatically charge the imaging liquid applied to surface 24 by developer roller 33. Imaging liquid supply 30 comprises a device configured to supply imaging liquid to developer roller 33.

In the example illustrated, imaging liquid supply 30 supplies a liquid toner. In one embodiment, imaging liquid supply 30 supplies a liquid carrier and colorant particles (also known as toner particles). The liquid carrier comprises an ink carrier oil, such as Isopar, a low molecular weight hydrocarbon oil. The liquid carrier may include other additional components such as a high molecular weight oil, such as mineral oil, a lubricating oil and a defoamer. In one embodiment, the liquid carrier and colorant particles comprises HEWLETT-PACKARD ELECTRO INK commercially available from Hewlett-Packard. In other embodiments, the imaging liquid may comprise other imaging liquids.

Developer roller 33 transfers and applies electrostatically charged imaging liquid to imaging surface 24. Developer roller 33 includes a shaft 37 and an exterior layer 39. Shaft 37 supports layer 39 for rotation about an axis 31.

Exterior layer 39 extends about shaft 37 and formed an exterior of roller 33. Layer 39 has an exterior surface 42 upon which the electrostatically charged imaging liquid is carried as it is being transferred to imaging surface 24. Surface 42 is rotated into contact or at lease close proximity to imaging surface 24. During such transfer, any gap between surfaces 42 and 24 is filled with the electrostatically charged imaging liquid being transferred. Although layer 39 is illustrated as being in direct contact with shaft 37, in other embodiments, additional intermediate layers may be provided between shaft 37 and layer 39.

Layer 39 is formed from materials or has a composition such that layer 39 has a desired level or range of electric conductivity so as to carry and transport like a statically charged imaging liquid to imaging surface 24. At the same time, the composition of layer reduces long-term damage to the imaging surface 24 or its performance over time. In the example illustrated, in which imaging surface 24 comprises a photoconductive polymer, such as the example formulation provided above, it is believed that certain materials, such as certain salts, contained in existing developer rollers leech out from the developer roller over time and coat upon imaging surface 24, degrading its performance. It is further believed that such materials may further deteriorate a life of imaging surface 24. In particular, such salts that have been plated upon surface 24 are believed to diffuse the generated electrostatic charge on surface 24. This charge diffusion reduces the sharpness and resolution of the electrostatic image and the subsequently printed image. Layer 39 has a composition that avoids or reduces this issue.

In the example illustrated, layer 39 is formed from one or more polymers, one or more electrical conductivity enhancers and one or more ionic salts that are soluble in a low molecular weight hydrocarbon oil. For purposes of this disclosure, a "low molecular weight hydrocarbon oil" or a "low molecular weight oil" comprises an oil having a carbon count ranging from $C_7$ (90 grams/mole molar mass) to $C_{25}$ (326 grams/mole molar mass). In one embodiment, layer 39 is formed from one or more polymers, one or more electrical conductivity enhancers and one or more ionic salts that are soluble in a low molecular weight hydrocarbon oil having a carbon count ranging from $C_7$ (90 grams/mole molar mass) to $C_{14}$ (198 grams/mole molar mass). The one or more electrical conductivity enhancers, such as carbon black, provide the polymer composition with electrical conductivity. The one of more ionic salts also assist in providing the polymer composition of layer 39 with ionic electrical conductivity. Because the composition includes a mixture of carbon black and one or more ionic salts, a desired level of electrical conductivity (and a desired corresponding level of electrical bulk resistivity) is achieved with a reduced likelihood of "hot spots" which may otherwise be associated with compositions that solely rely upon carbon black for providing the desired level of electric conductivity. At the same time, the carbon black allows the use of ionic salts which are less damaging to imaging service 24 but which have a lower electrical conductivity as compared to other high electrical conductivity salts that are used in compositions that rely completely upon ionic salts for providing the electrical conductivity of layer 39.

Because the ionic salts in the composition of layer 39 are soluble in low molecular weight hydrocarbon oil, any of the ionic salts that leeches from layer 39 over time is largely dissolved in the liquid carrier or imaging oil of the imaging liquid being transferred to imaging surface 24. This liquid carrier, largely comprised of low molecular weight imaging oil, simply carries the colorant particles and transfers the colorant particles to imaging surface 24. The imaging oil itself does not substantially accumulate on imaging service 24. As a result, the ionic salts dissolved in the liquid carrier flow through printer 20 with the liquid carrier. Any contact between the leached ionic salts and imaging service 24 is largely temporary such that the ionic salts are not permitted to substantially coat imaging surface 24 and are not in contact with imaging surface 24 a sufficient period of time so as to substantially damage imaging surface 24. As a result, the composition of layer 39 provides a desired level of electrical conductivity and reduces long-term damage to the imaging surface 24 or its performance over time In the example illustrated, layer 39 is provided with an electrical bulk resistivity of between about $1\times10^5$ and about $1\times10^7$ ohm/cm. In the example illustrated, the composition of layer 39 comprises a polyurethane mixed with a highly structured carbon-14 and a quarternary ammonium sulfate with an aliphatic hydrocarbon chain. According to one embodiment, layer 39 has the following composition:

(1) Polyol (component A): Polyol, ester-based polyol, Diethylene glycol—Adipic acid copolymer polyol, Trade name: Bayer Desmophen F207-60a;
(2) Isocyanate (component B): Isocyanate, polymeric methylene diphenyl isocyanate (MDI), Trande name: Bayer Mondur MR Light;
(3) Conducting agent (salt): Ammonium Sulfate salt, Trade name: Larostat 364A (range 1-3% wt);
(4) Conducting agent (carbon black): Carbon black, high surface area carbon black: Trade name: Akzo Nobel Ketjen Black EC600JD (range 0.1 to 0.8% wt),
(5) Antihydrolysis agent: Carbodiimide, Trade name: RheinChem Staboxal P200 (1-3% wt); and
(6) Catalyst: 1,4-Diazabicyclo[2.2.2]octane solution, trade name: Dabco 33-LV (0.01 to 1% wt).

According to one embodiment, the composition of layer 39 is formed by reacting and isocyanate and an ester based polyol to form a polyurethane, a low hardness elastomer. Prior to this reaction, the polyol is high shear mixed with an ammonium sulfate alkyl chain salt (such as commercially available LAROSTAT 264A by BASF) and a highly structured carbon black (such as Ketj en Black EC600JD by AkzoNobel or Vulcan X72R by Cabot Corp.). The ratio of the polyol to isocyanate mixture results in a rubber material with a durometer of between about 30 and about 38 Shore A. The ammonium sulfate alkyl chain salt (LAROSTAT 264A) is added between 1-3 parts per hundred parts (pphp) polyol and mixed with a carbon black of 0.1 to 0.8 pphp polyol. In other embodiments, the particular salts and relative percentages of salts and carbon black may be adjusted so as to tune a bulk resistivity of layer 39 and of developer roller 33.

Figure 2:
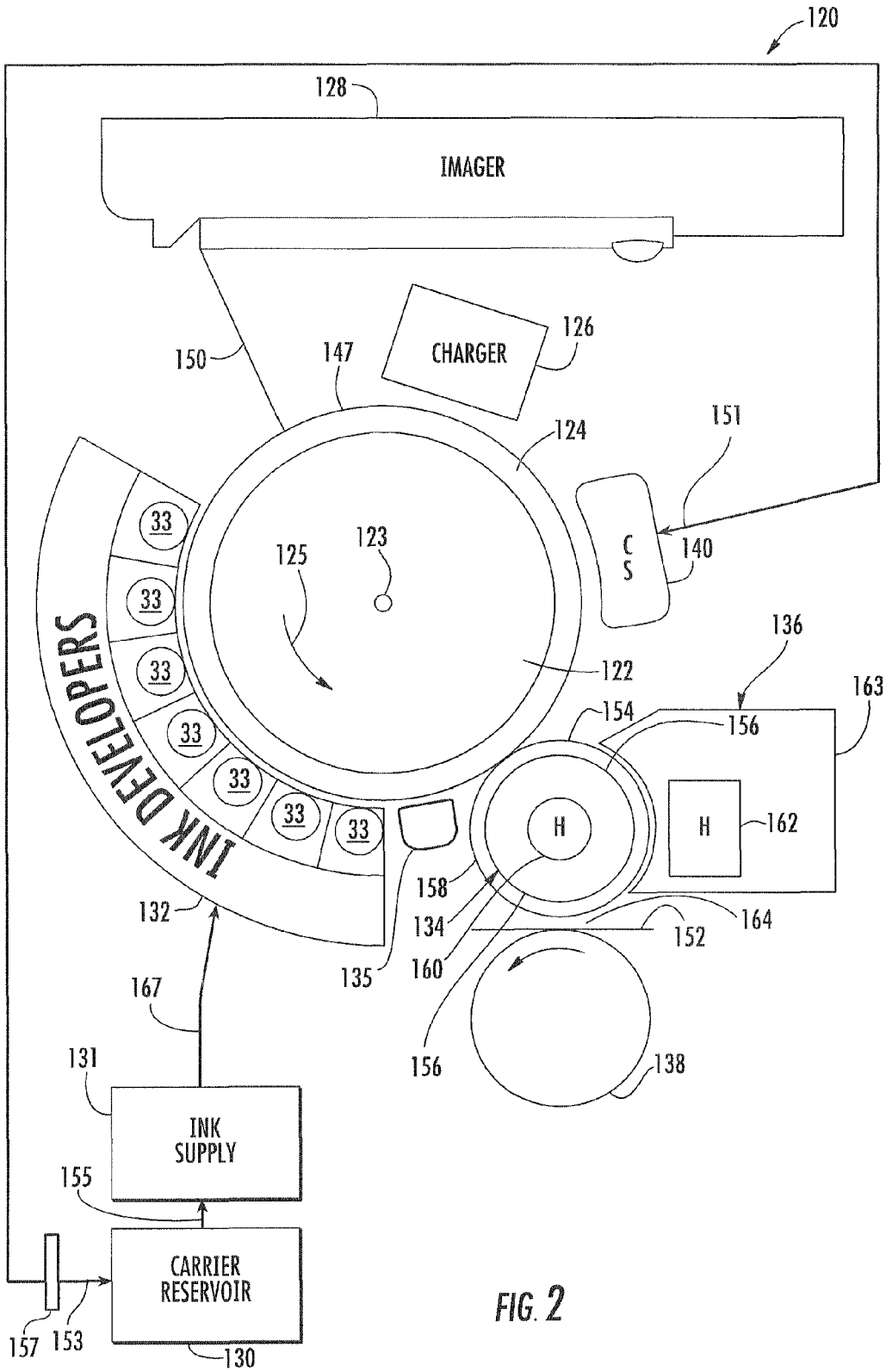
FIG. 2 is a schematic illustration of another embodiment of the printer of FIG. 1 according to an example embodiment.

FIG. 2 schematically illustrates printer 120, another embodiment of printer 20 shown in FIG. 1. Like printer 20, printer 120 utilizes developer rollers 33. Printer 120 comprises a liquid electrophotographic (LEP) printer. Printer 120, (sometimes embodied as part of an offset color press) includes drum 122, photoconductor 124, charger 126, imager 128, ink carrier oil reservoir 130, ink supply 131, developer 132, internally and/or externally heated intermediate transfer member 134, heating system 136, impression member 138 and cleaning station 140.

Drum 122 comprises a movable support structure supporting photoconductor 124. Drum 122 is configured to be rotationally driven about axis 123 in a direction indicated by arrow 125 by a motor and transmission (not shown). As a result, distinct surface portions of photoconductor 124 are transported between stations of printer 120 including charger 126, imager 128, ink developers 132, transfer member 134 and charger 134. In other embodiments, photoconductor 124 may be driven between substations in other manners. For example, photoconductor 124 may be provided as part of an endless belt supported by a plurality of rollers.

Photoconductor 124, also sometimes referred to as a photoreceptor, comprises a multi-layered structure configured to be charged and to have portions selectively discharged in response to optical radiation such that charged and discharged areas form a discharged image to which charged printing material is adhered.

Charger 126 comprises a device configured to electrostatically charge surface 147 of photoconductor 124. In one embodiment, charger 126 comprises a charge roller which is rotationally driven while in sufficient proximity to photoconductor 124 so as to transfer a negative static charge to surface 147 of photoconductor 124. In other embodiments, charger 126 may alternatively comprise one or more corotrons or scorotrons. In still other embodiments, other devices for electrostatically charging surface 147 of photoconductor 124 may be employed.

Imager 128 comprises a device configured to selectively electrostatically discharge surface 147 so as to form an image. In the example shown, imager 128 comprises a scanning laser which is moved across surface 147 as drum 122 and photoconductor 124 are rotated about axis 123. Those portions of surface 147 which are impinged by light or laser 150 are electrostatically discharged to form an image (or latent image) upon surface 147. In other embodiments, imager 128 may alternatively comprise other devices configured to selectively emit or selectively allow light to impinge upon surface 147. For example, in other embodiments, imager 128 may alternatively include one or more shutter devices which employ liquid crystal materials to selectively block light and to selectively allow light to pass to surface 147. In yet other embodiments, imager 128 may alternatively include shutters which include micro or nano light-blocking shutters which pivot, slide or otherwise physically move between a light blocking and light transmitting states.

Ink carrier reservoir 130 comprises a container or chamber configured to hold ink carrier oil for use by one or more components of printer 120. In the example illustrated, ink carrier reservoir 130 is configured to hold ink carrier oil for use by cleaning station 140 and ink supply 131. In one embodiment, as indicated by arrow 151, ink carrier reservoir 130 serves as a cleaning station reservoir by supplying ink carrier oil to cleaning station 140 which applies the ink carrier oil against photoconductor 124 to clean the photoconductor 124. In one embodiment, cleaning station 140 further cools the ink carrier oil and applies ink carrier oil to photoconductor 124 to cool surface 147 of photoconductor 124. For example, in one embodiment, cleaning station 140 may include a heat exchanger or cooling coils in ink care reservoir 130 to cool the ink carrier oil. In one embodiment, the ink carrier oil supply to cleaning station 140 further assists in diluting concentrations of other materials such as particles recovered from photoconductor 124 during cleaning.

After ink carrier oil has been applied to surface 147 to clean and/or cool surface 147, the surface 147 is wiped with an absorbent roller and/or scraper. The removed carrier oil is returned to ink carrier reservoir 130 as indicated by arrow 153. In one embodiment, the ink carrier oil returning to ink carrier reservoir 130 may pass through one or more filters 157 (schematically illustrated). As indicated by arrow 155, ink carrier oil in reservoir 130 is further supplied to ink supply 131. In other embodiments, ink carrier reservoir 130 may alternatively operate independently of cleaning station 140, wherein ink carrier reservoir 130 just supplies ink carrier oil to ink supply 131.

Ink supply 131 comprises a source of printing material for ink developers 132. Ink supply 131 receives ink carrier oil from carrier reservoir 130. As noted above, the ink carrier oil supplied by ink carrier reservoir 130 may comprise new ink carrier oil supplied by a user, recycled ink carrier oil or a mixture of new and recycling carrier oil. Ink supply 131 mixes being carrier oil received from ink carrier reservoir 130 with pigments or other colorant particles. The mixture is applied to ink developers 132 as needed by ink developers 132 using one or more sensors and solenoid actuated valves (not shown).

In the particular example shown, the raw, virgin or unused printing material may comprise a liquid or fluid ink comprising a liquid carrier and colorant particles. The colorant particles have a size of less than 2μ. In different embodiments, the particle sizes may be different. In the example illustrated, the printing material generally includes approximately 3% by weight, colorant particles or solids part to being applied to surface 147. In one embodiment, the colorant particles include a toner binder resin comprising hot melt adhesive.

In one embodiment, the liquid carrier comprises an ink carrier oil, such as Isopar, and one or more additional components such as a high molecular weight oil, such as mineral oil, a lubricating oil and a defoamer. In one embodiment, the printing material, including the liquid carrier and the colorant particles, comprises HEWLETT-PACKARD ELECTRO INK commercially available from Hewlett-Packard.

Ink developers 132 comprises devices configured to apply printing material to surface 147 based upon the electrostatic charge upon surface 147 and to develop the image upon surface 147. According to one embodiment, ink developers 132 comprise binary ink developers (BIDs) circumferentially located about drum 122 and photoconductor 124. Such ink developers are configured to form a substantially uniform 6μ thick electrostatically charged film composed of approximately 20% solids which is transferred to surface 147. In yet other embodiments, ink developers 132 may comprise other devices configured to transfer electrostatically charged liquid printing material or toner to surface 147. In still other embodiments, developers 132 may be configured to apply a dry electrostatically charged printing material, such as dry toner, to surface 147.

As shown by FIG. 2, each of ink developers 132 includes a developer roller 33. As discussed above, developer rollers 33 have an outer layer 39 (shown in FIG. 1) that provides a desired level or range of electric conductivity/resistance so as to carry and transport electrostatically charged imaging liquid to imaging surface 24. At the same time, the composition of layer 39 reduces long-term damage to the imaging surface provided by photoconductor 124 or its performance over time.

Intermediate transfer member 134 comprises a member configured to transfer the printing material upon surface 147 to a print medium 152 (schematically shown). Intermediate transfer member 134 includes an exterior surface 154 which is resiliently compressible and which is also configured to be electrostatically charged. Because surface 154 is resiliently compressible, surface 154 conforms and adapts to irregularities in print medium 152. Because surface 154 is configured to be electrostatically charged, surface 154 may be charged so as to facilitate transfer of printing material from surface 147 to surface 154. In one embodiment, intermediate transfer member 134 may include a drum 156 and an external blanket 158. Drum 156 supports blanket 158 which provides intermediate transfer member 134 with surface 154. In other embodiments, intermediate transfer member 134 may have other configurations. For example, in other embodiments, intermediate transfer member 134 may alternatively comprise an endless belt supported by a plurality of rollers in contact with or in close proximity to surface 147.

Heating system 136 comprises one or more devices configured to apply heat to printing material being carried by surface 154 from photoconductor 124 to medium 152. In the example illustrated, heating system 136 includes internal heater 160, external heater 162 and vapor collection plenum 163. Internal heater 160 comprises a heating device located within drum 156 that is configured to emit heat or inductively generate heat which is transmitted to surface 154 to heat and dry the printing material carried at surface 154. External heater 162 comprises one or more heating units located about transfer member 134. According to one embodiment, heaters 160 and 162 may comprise infrared heaters.

Heaters 160 and 162 are configured to heat printing material to a temperature of at least 85° C. and less than or equal to about 110° C. In still other embodiments, heaters 160 and 162 may have other configurations and may heat printing material upon transfer member 134 to other temperatures. In particular embodiments, heating system 136 may alternatively include one of either internal heater 160 or external heater 162.

Vapor collection plenum 163 comprises a housing, chamber, duct, vent, plenum or other structure at least partially circumscribing intermediate transfer member 134 so as to collect or direct ink or printing material vapors resulting from the heating of the printing material on transfer member 134 to a condenser (not shown).

Impression member 138 comprises a cylinder adjacent to intermediate transfer member 134 so as to form a nip 164 between member 134 and member 138. Medium 152 is generally fed between transfer member 134 and impression member 138, wherein the printing material is transferred from transfer member 134 to medium 152 at nip 164. Although impression member 138 is illustrated as a cylinder or roller, impression member 138 and alternatively comprise an endless belt or a stationary surface against which intermediate transfer member 134 moves.

Cleaning station 140 comprises one or more devices configured to remove any residual printing material from photoconductor 124 prior to surface areas of photoconductor 124 being once again charged at charger 126. In one embodiment, cleaning station 140 may comprise one or more devices configured to apply a cleaning fluid to surface 147, wherein residual toner particles are removed by one or more is absorbent rollers. In one embodiment, cleaning station 140 may additionally include one or more scraper blades. In yet other embodiments, other devices may be utilized to remove residual toner and electrostatic charge from surface 147.

In operation, ink developers 132 develop an image upon surface 147 by applying electrostatically charged ink having a negative charge. Once the image upon surface 147 is developed, charge eraser 135, comprising one or more light emitting diodes, discharges any remaining electrical charge upon such portions of surface 147 and ink image is transferred to surface 154 of intermediate transfer member 34. In the example shown, the printing material formed comprises and approximately 1.0μ thick layer of approximately 90% solids color or particles upon intermediate transfer member 134.

Heating system 136 applies heat to such printing material upon surface 154 so as to evaporate the carrier liquid of the printing material and to melt toner binder resin of the color and particles or solids of the printing material to form a hot melt adhesive. Thereafter, the layer of hot colorant particles forming an image upon surface 154 is transferred to medium 152 passing between transfer member 134 and impression member 138. In the embodiment shown, the hot colorant particles are transferred to print medium 152 at approximately 90° C. The layer of hot colorant particles cool upon contacting medium 152 on contact in nip 164.

These operations are repeated for the various colors for preparation of the final image to be produced upon medium 152. In other embodiments, in lieu of creating one color separation at a time on a surface 154, sometimes referred to as "multi-shot" process, the above process may be modified to employ a one-shot color process in which all color separations are layered upon surface 154 of intermediate transfer member 134 prior to being transferred to and deposited upon medium 152.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:
a roller (33) comprising:
a shaft (37);
a layer (39) about the shaft (37), the layer (39) forming an exterior of the roller (33) and comprising:
one or more polymers;
carbon black; and
an ionic salt soluble in a low molecular weight hydrocarbon oil.

2. The apparatus of claim number 1, wherein the one of more polymers include polyurethane.

3. The apparatus of claim 1, wherein the ionic salt comprises a quarternary ammonium sulfate with an aliphatic hydrocarbon chain.

4. The apparatus of claim 1, wherein the ionic salt includes an aliphatic hydrocarbon chain.

5. The apparatus of claim 1, wherein the layer (39) has a bulk resistivity of between about $1\times10^5$ ohm/cm and about $1\times10^7$ ohm/cm.

6. The apparatus of claim 1 further comprising a drum (22, 122) having an outer photoconductive polymer layer (24, 124) opposite the roller (33).

7. The apparatus of claim 6 further comprising a source of low molecular weight hydrocarbon oil having suspended toner particles, the source configured to apply the low molecular weight hydrocarbon oil to the layer (39) of the roller (33) and wherein the roller (33) transfers the low molecular weight hydrocarbon oil to the photoconductive polymer layer (24, 124) of the drum (22, 122).

8. The apparatus of claim 7 further comprising a second roller (33) opposite the outer photoconductive polymer layer of the drum (22, 122), the second roller (33) comprising:
a second shaft (37);
a second layer (39) about the shaft (37), the second layer (39) forming an exterior of the second roller (33) and comprising:
one or more polymers;
carbon black; and
an ionic salt soluble in a low molecular weight hydrocarbon oil.

9. The apparatus of claim 1, wherein the one or more polymers include polyurethane, wherein the ionic salt includes an aliphatic hydrocarbon chain and wherein the layer (39) has a bulk resistivity of between about $1\times10^5$ ohm/cm and about $1\times10^7$ ohm/cm.

10. A method comprising:
transferring a low molecular weight hydrocarbon imaging oil to a photo conductive polymer layer on a drum (22, 122) with a roller (33) having an outer layer (39) comprising:
one or more polymers;
carbon black; and
an ionic salt soluble in a low molecular weight hydrocarbon oil.

11. The method of claim 10, wherein the one of more polymers include polyurethane.

12. The method of claim 10, wherein the ionic salt comprises a quarternary ammonium sulfate with an aliphatic hydrocarbon chain.

13. The method of claim 10, wherein the ionic salt includes an aliphatic hydrocarbon chain.

14. The method of claim 10, wherein the layer (39) has a bulk resistivity of between about $1\times10^5$ ohm/cm and about $1\times10^7$ ohm/cm.

15. The method of claim 10, wherein the one or more polymers include polyurethane, wherein the ionic salt includes an aliphatic hydrocarbon chain and wherein the layer (39) has a bulk resistivity of between about $1\times10^5$ ohm/cm and about $1\times10^7$ ohm/cm.

* * * * *

UNITED STATES PATENT AND TRADEMARK OFFICE

CERTIFICATE OF CORRECTION

PATENT NO. : 8,594,535 B2
APPLICATION NO. : 13/119959
DATED : November 26, 2013
INVENTOR(S) : Benjamin W. C. Garcia It is certified that error appears in the above-identified patent and that said Letters Patent is hereby corrected as shown below:

In the Claims

Column 8, line 3, in Claim 2, after "claim" delete "number".

Column 8, line 3, in Claim 2, delete "one of" and insert -- one or --, therefor.

Column 8, line 6, in Claim 3, delete "quarternary" and insert -- quaternary --, therefor.

Column 8, line 48, in Claim 11, delete "one of" and insert -- one or --, therefor.

Column 8, line 51, in Claim 12, delete "quarternary" and insert -- quaternary --, therefor.

Signed and Sealed this
Fifteenth Day of April, 2014

Michelle K. Lee

Michelle K. Lee
*Deputy Director of the United States Patent and Trademark Office*